United States Patent [19]

Everman

[11] Patent Number: 4,872,493

[45] Date of Patent: Oct. 10, 1989

[54] APPARATUS FOR FILLING A LINED CONTAINER

[75] Inventor: Wayne F. Everman, Cedar Falls, Iowa

[73] Assignee: Container Corporation of America, Clayton, Mo.

[21] Appl. No.: 192,411

[22] Filed: May 10, 1988

[51] Int. Cl.[4] ..... B65B 31/06

[52] U.S. Cl. ..... 141/59; 141/80; 141/65; 141/114; 141/73; 141/67

[58] Field of Search ..... 141/59, 10, 83, 65, 141/286, 60, 66, 67, 68, 114, 73, 80

[56] References Cited

U.S. PATENT DOCUMENTS

| | | | |
|---|---|---|---|
| 2,532,871 | 12/1950 | Wagner | 53/449 |
| 3,384,134 | 5/1968 | Hillerns | 141/286 |
| 3,396,763 | 8/1968 | Van Pernis | 141/68 |
| 3,788,368 | 1/1974 | Geng et al. | 141/67 |
| 4,084,390 | 5/1978 | Schmachtel et al. | 141/65 |
| 4,099,598 | 7/1978 | Clinard | 141/313 |
| 4,182,386 | 1/1980 | Alack | 141/83 |
| 4,182,591 | 1/1980 | Stanelle | 141/93 |
| 4,340,136 | 7/1982 | Hanrot et al. | 141/93 |
| 4,579,154 | 4/1986 | Müller | 141/59 |
| 4,586,549 | 5/1986 | White | 141/67 |
| 4,590,974 | 5/1986 | Mathews | 141/286 |
| 4,614,213 | 9/1986 | Englin | 141/59 |
| 4,669,950 | 6/1987 | St. Lawrence | 141/1 |
| 4,688,371 | 8/1987 | Hecht | 141/83 |
| 4,698,951 | 10/1987 | Everman et al. | 53/449 |
| 4,703,782 | 11/1987 | Henkel, Sr. | 141/59 |
| 4,738,287 | 4/1988 | Klinkel | 141/67 |

OTHER PUBLICATIONS

French reference 2495102-6/4/82, see FIGS. 1-4.

*Primary Examiner*—Henry J. Recla
*Assistant Examiner*—Edward C. Donovan
*Attorney, Agent, or Firm*—Richard W. Carpenter

[57] ABSTRACT

Apparatus and method for filling a bulk container with particulate material from a source through a filling spout assembly that includes a pair of concentric inner and outer tubes connectable to the source and to a container opening, respectively, whereby while material is being delivered to the container from the source through the inner spout member, air is introduced into the container and is being exhausted from the container through a pair of air transfer ducts.

1 Claim, 5 Drawing Sheets

APPARATUS FOR FILLING A LINED CONTAINER

BACKGROUND OF THE INVENTION

1. Field of the Invention

This invention relates generally to arrangement for filling lined bulk shipping containers with particulate material and more particularly to an apparatus to help compact the material entering the container and for method for introducing air into a container and exhausting air and dust from the container at the same time the container is being filled.

2. Description of the Background Art

A background art search directed to the subject matter of this application and conducted in the United States Patent and Trademark Office disclosed the following United States Letter Patent:

| | | | | |
|---|---|---|---|---|
| 4,698,951 | 4,669,950 | 4,614,213 | 4,586,549 | 4,579,154 |
| 4,310,136 | 4,182,591 | 4,099,598 | 4,084,390 | 3,788,368 |
| 2,532,871. | | | | |

None of the patents uncovered in the background search discloses a lined bulk container filling arrangement wherein, at the same time that the container is being filled with particulate material, air is introduced into the container and exhausted from the container through a filling spout assembly that includes a pair of generally concentric cylindrical spout members, one of which is used for the passage of the air into and out of the container and the other of which is used to deliver material to the container from an outside source.

SUMMARY OF THE INVENTION

It is an object of the present invention to provide an improved filling apparatus and method that is intended to minimize the time required to fill a bulk container with particulate material, to improve settling of the material in the container, and to exhaust the dust that arises during filling.

Another object of the invention is to provide a bulk container filling method and apparatus that helps inflate a liner bag, when one is used, by pressing it flat against the inner surfaces of the container walls, so the container can be completely filled once the filling operation starts.

Another object of the invention is to provide a filling system whereby the operator does not have to enter the fill station to prepare the container for filling, but where he can do it outside of the fill station while another container is being filled at the fill station.

A more specific object of the invention is to provide an apparatus and method for filling bulk containers wherein air is introduced into and exhausted from the container at the same time the container is being filled with particulate material.

These and other objects of the invention will be apparent from an examination of the following description and drawings.

Figure 1:
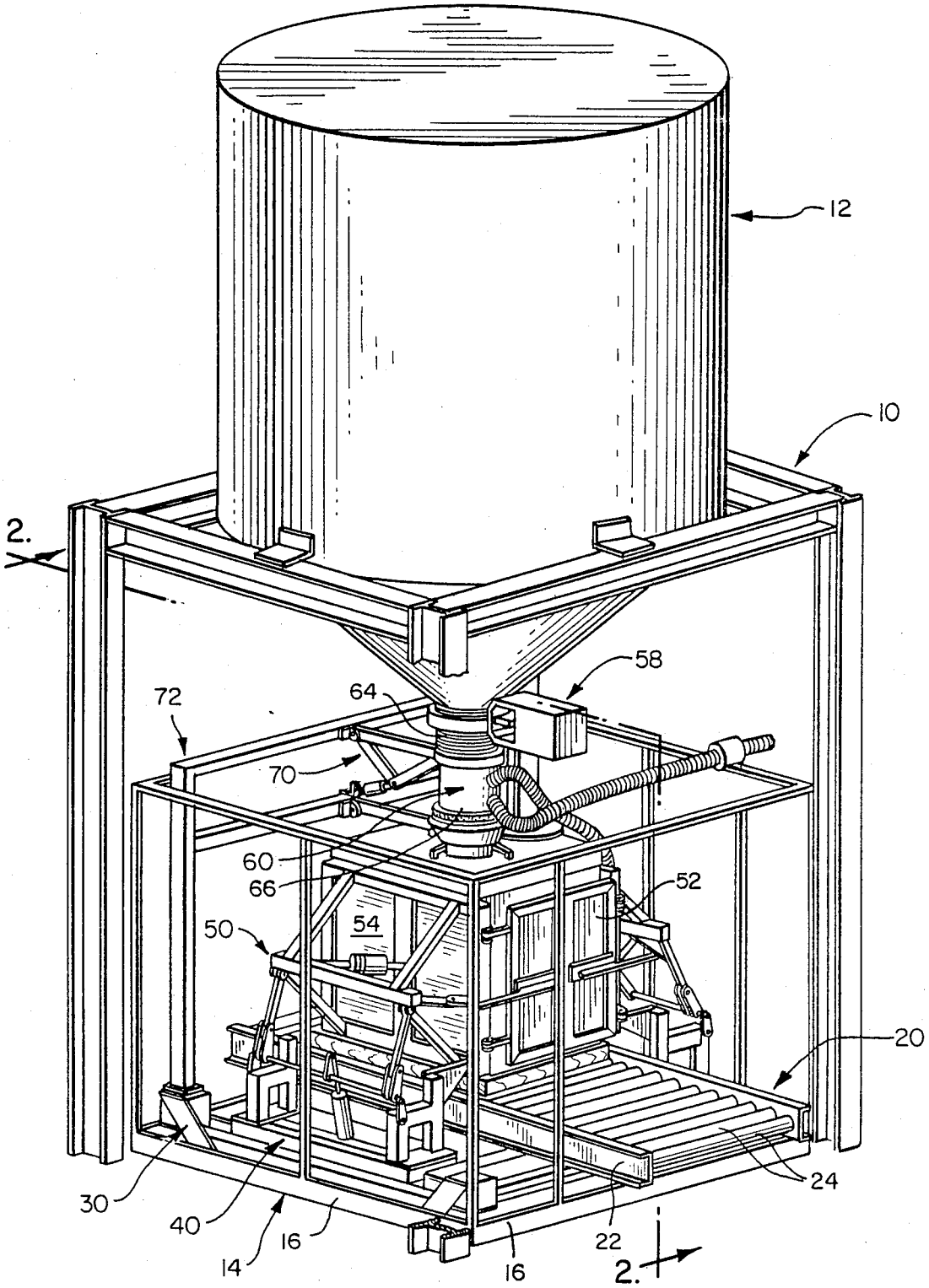
FIG. 1 is a fragmentary perspective view of a fill station wherein bulk containers can be filled with particulate material utilizing the apparatus and method of the present invention.

It will be understood that, for purposes of clarity, certain elements have been intentionally omitted from certain view where they are believed to be illustrated to better advantage in other views.

DESCRIPTION OF THE PREFERRED EMBODIMENT

An open top bulk container is usually prepared for filling with particulate material by placing a liner bag in the container and cuffing the bag over the upper end of the container. The container is then placed under a fill spout where particulate material is delivered into the container. This procedure is objectionable, because dust is generated causing crosscontamination between fill station. Also, product spillage occurs, particlarly where vibratory settling is utilized to compact the contents of the container.

Some of these problems are also present when the container being filled does not have an inner liner bag, but wherein the particulate material is delivered directly into the container.

The present invention contemplates an improved means for filling with particulate material a bulk container either having or not having an inner liner bag. One of the problems in filling a container with particulate material is that of getting the material compacted properly, and another is that of removing dust from the air.

This is accomplished in the present invention by a novel filling spout assembly that enables air to be delivered into and exhausted from the container through one opening, while the product is delivered from a source through another opening in the filling spout assembly.

Referring now to the drawings for a better understanding of the invention, it will be seen that the container indicated generally at K in the drawings is a three-piece, paperboard container having, in a top wall thereof, a filling opening H which can be closed with a lid or cover C after the container has been filled. In the embodiment illustrated in FIGS. 2 and 3, the container K has an inner liner bag L adapted to hold the particulate material M with which the container is to be filled.

The container K is normally positioned on a pallet P, so that it can travel on a conveyor through the fill station.

Figure 2:
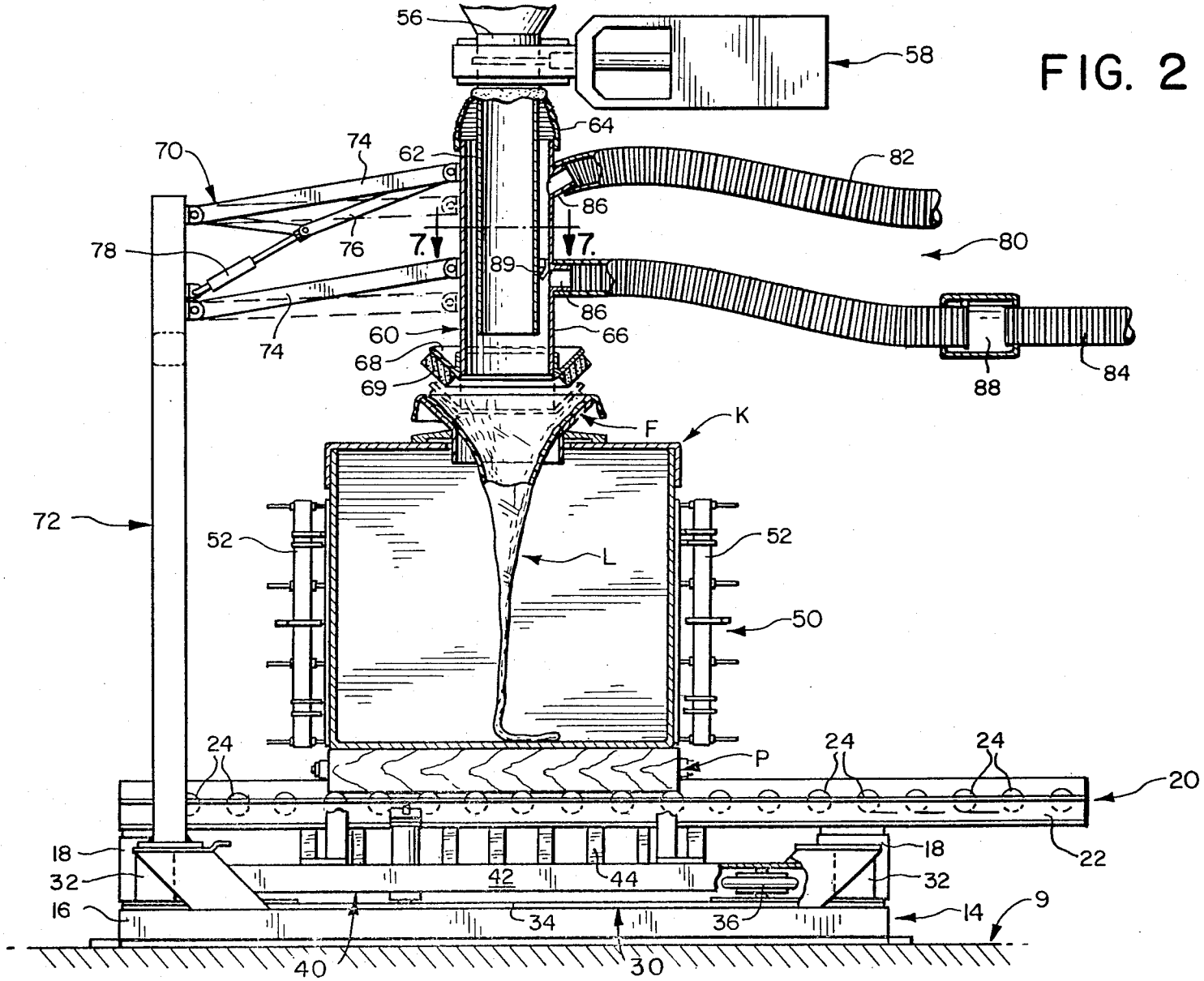
FIG. 2 is a fragmentary transverse, vertical, sectional view taken on line 2—2 of FIG. 1, showing the apparatus prior to commencement of a filling operation.

Still referring to FIGS. 1 and 2, it will be seen that the filling apparatus includes an upper frame structure, indicated generally at 10, adapted to hold a hopper 12 containing the particulate material M.

The apparatus also includes a lower frame structure or base 14 having transversely and longitudinally extending horizontal members, 16 adapted to support a scale assembly 30 and a vibrating assembly 40, and a plurality of vertical members 18, adapted to support a conveyor 20.

Conveyor 20 is a conventional roller-type conveyor that includes a pair of parallel side rails 22 and a plurality of rollers 24 extending transversely between the side rails 22.

Figure 4:
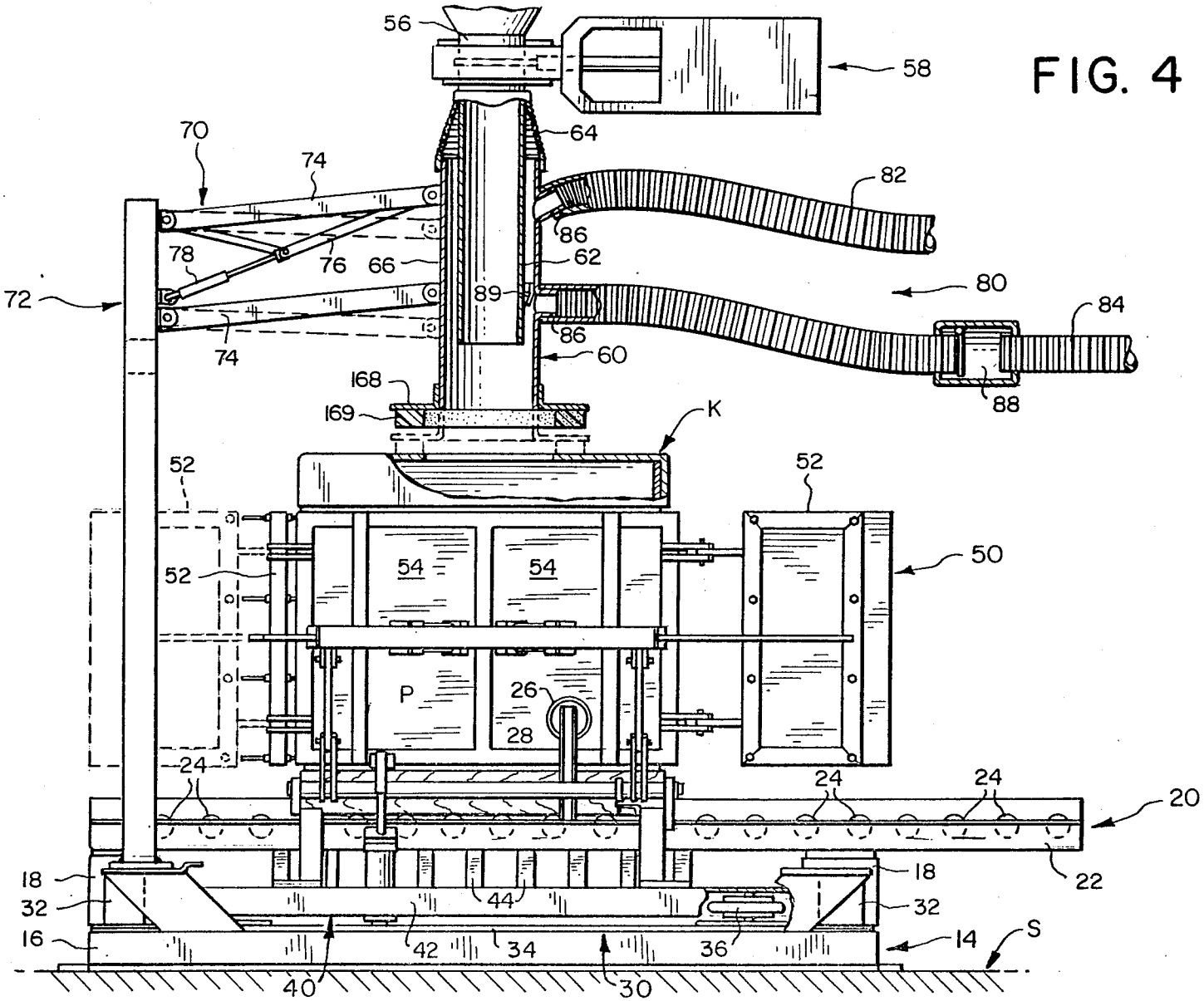
FIG. 4 is a view similar to FIG. 2, but illustrating a slightly modified form of the invention.

As best seen in FIG. 4, the apparatus may be provided with a photocell 26 and a reflector 28 adapted to control the filling apparatus, so that it becomes operational when a container is positioned on the conveyor in the fill station.

The scale assembly 30 is used to weight the container and material as the container is being filled to insure that the correct amount of product is put into the container. The details of the scale assembly are not described in this application, because they are the subject of a co-pending application: Serial Number 067,533, filed June 29, 1987, in the name of the same inventor, Wayne F. Everman. Scale assembly 30 includes a plurality of load cells 32 positioned at the corners of the base to support a platform 34, which in turn supports other portions of the filling apparatus.

In order to vibrate the container and contents during the filling operation, there may be provided a vibrating assembly, indicated generally at 40, the details of which are described in the previously referred to co-pending patent application.

The vibrating assembly 40 includes a deck 42 supported by air cushions 36 located at the corners of the scale platform 34. The vibrating assembly also includes a vibrating mechanism, not shown, which is positioned under a deck 42. Extending upwardly from deck 42 are a plurality of projections 44 which are so positioned as to be able to extend between the rollers 24 of the conveyor 20 for engagement with the underside of pallet P when the vibrating mechanism is in the operative or upper position, as shown in FIG. 3.

Figure 3:
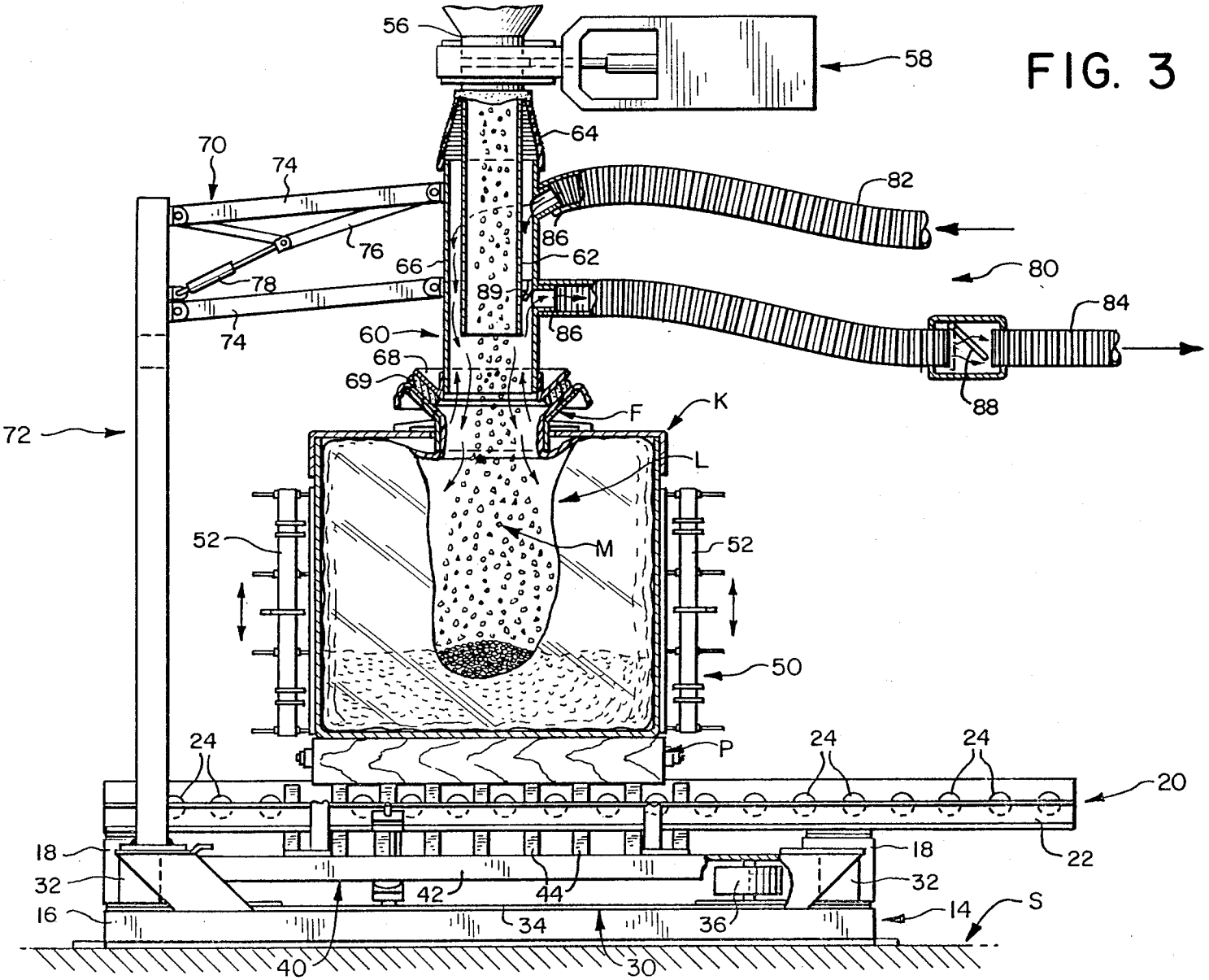
FIG. 3 is a view similar to FIG. 2, but showing the apparatus during the filling operation.

The vibrating mechanism is moved between the non-operating or lowered position, illustrated in FIG. 2, and the operating or raised position, shown in FIG. 3, by the inflation or deflation of the air cushions 36 positioned at the corners of the apparatus between the scale platform 34 and the deck 42 of the vibrating assembly.

In order to keep the container in position and prevent it from "walking" off of the conveyor while it is being vibrated, there may be provided a clamping mechanism, indicated generally at 50, which includes front and rear doors 52 and side doors 54. The details of this mechanism are also described in the previously mentioned application and are not repeated in this co-application.

As previously mentioned, the essential feature of this invention resides in the provision of the novel filling spout assembly, indicated generally at 60 in FIGS. 2–6, which is positioned under hopper 12 and connected at its upper end to the lower end of a conduit 56 depending from the hopper.

Positioned between filling spout assembly 60 and hopper 12, and also connected to conduit 56, is a slide valve assembly, indicated generally at 58. As this may be a conventional slide valve arrangement the details of the structure are not illustrated or described in the present application.

Referring to FIGS. 2-6, it will be seen that the novel filling spout assembly 60 includes a generally cylindrical inner spout member 62, the upper end of which is fixedly secured to discharge opening of adjacent slide valve 58. The filling spout assembly also includes a generally cylindrical outer spout member 66 that has its upper end attached to the upper end of the inner spout member 62 by means of a flexible bellows 64 which allows the outer spout member to move axially relative to the fixed inner spout member.

Mounted at the lower end of movable outer spout member 66 is a generally funnel shaped flange 68 having a conical seal 69 secured to the outer surface thereof for engagement with a filling funnel F positioned in the filling opening H of the container K.

The inner spout member 62 is supported by slide valve 58 to which it is attached. Outer spout member 66 is carried by a support assembly, indicated generally at 70, that includes an upper structure 72, mounted on the scale platform 34, and a pair of upper and lower generally horizontally extending parallel arms 74 connecting outer spout 66 member to the upper structure 72.

In order to move the outer spout member up and down there is provided operating linkage 76 that is actuated by a pneumatic or hydraulic cylinder 78, also carried by the upper structure 72.

The purpose of moving the outer spout member between the filling position shown in FIG. 3 and the non-filling position shown in FIG. 2 is simply to enable the container to be moved out of the fill station while another container is moved into the fill station. Once the container is in position, the movable outer spout member 66 can be lowered slightly to allow the flange seal 69 to engage filling funnel F, as illustrated in FIG. 3.

If a liner bag is used, it is inserted into the container loosely before the container is moved into the fill station. At the same time, filling funnel F is inserted into the opening of the container, and the neck of the liner bag is passed through and cuffed over the upper end of the filling funnel as shown in FIG. 2.

As the container is being filled with particulate material, air is brought into and exhausted from the container through an air transfer mechanism, indicated generally at 80 in FIG. 2-6.

The air transfer mechanism includes an intake duct 82 and an exhaust duct 84, both of which are flexible and are connected to nipples 86 which extend outwardly from outer spout member 66. The exhaust duct 84 may be provided with a low pressure automatic relief valve 88. When air is first introduced into the container through intake duct 82, it serves to inflate the liner bag L and press it against the inner surface of the container. As the liner bag L is inflated and pressed against the inner surfaces of the outer container C, the air in the container between the outer surface of the liner bag and the inner surfaces of the container is forced out of the container through the hatch hole H which, as best seen in FIGS. 3 and 4, has a diameter slightly larger than the outer diameter of the funnel F. This is important, because, in order for the liner bag to be filled completely, it must be inflated completely and disposed against the inner surfaces of the container. During the filling operation the incoming air helps to settle the material. At the same time the air being exhausted from the container carries with it the extra dust that is undesirable.

Figure 5:
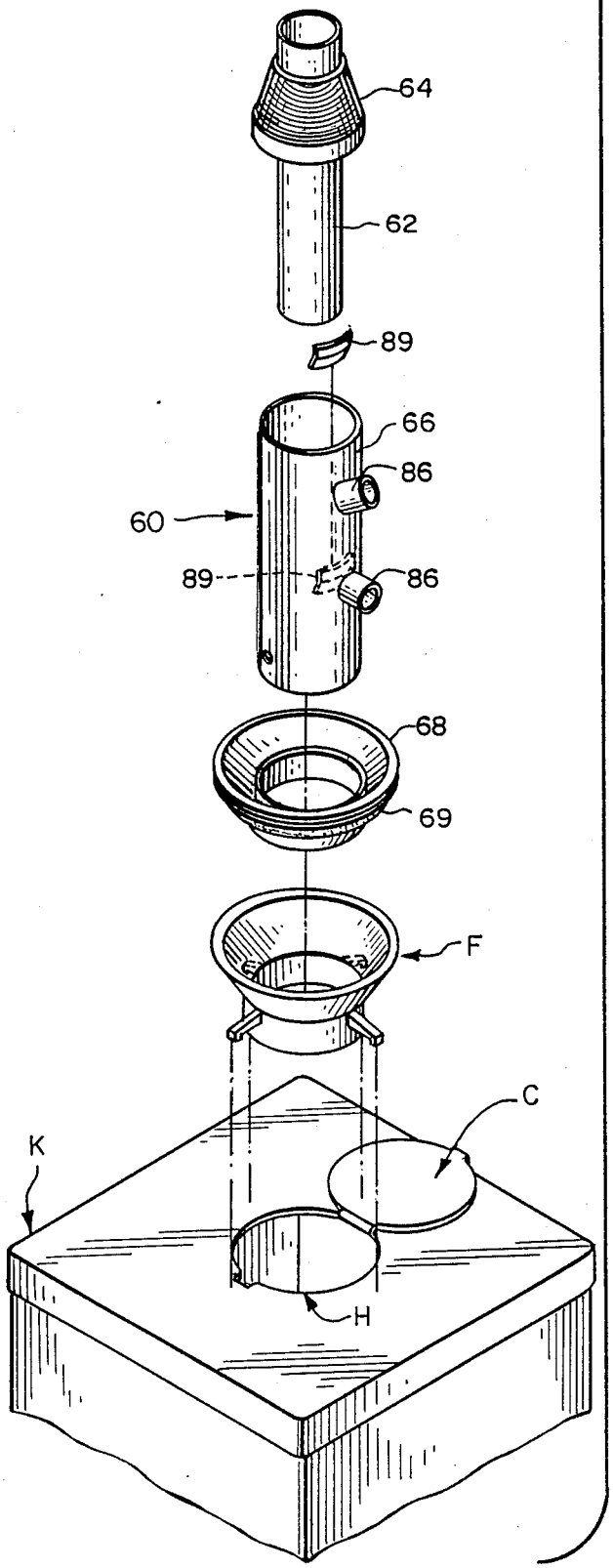
FIG. 5 is an exploded perspective view illustrating the pouring spout assembly illustrated in the other views.
Figure 7:
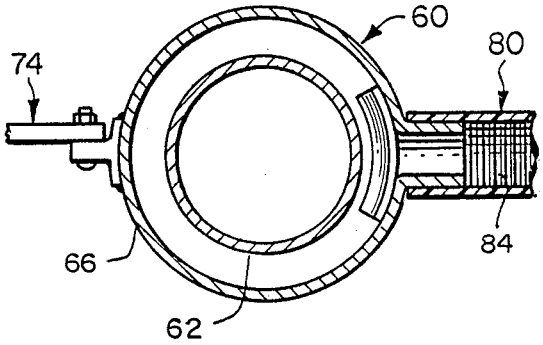
FIG. 7 is a fragmentary transverse, horizontal, sectional view taken on line 7—7 of FIG. 2.
Figure 6:
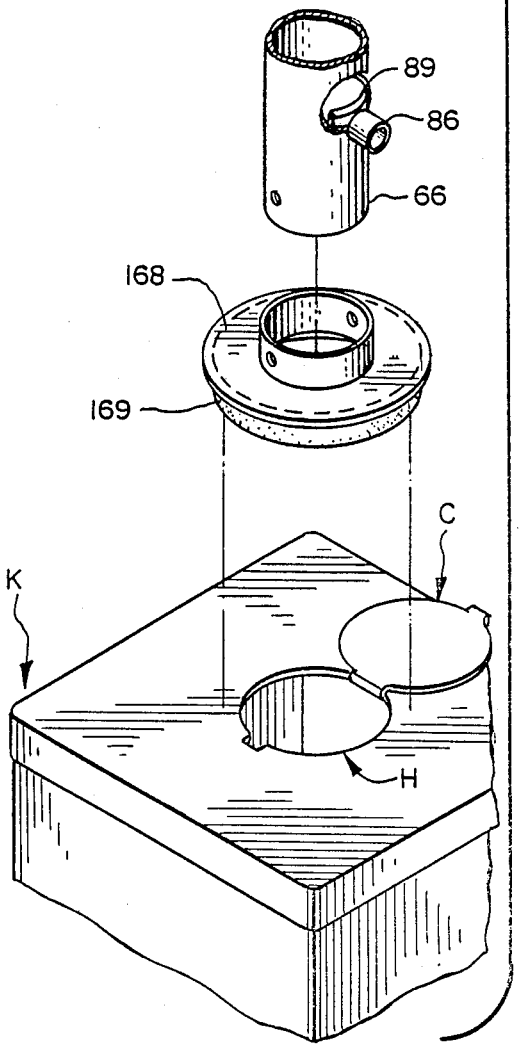
FIG. 6 is a view similar to FIG. 5, but illustrating a slightly modified form of the invention.

As best seen in FIG. 5, a baffle plate 89 is positioned inside the outer spout member 66 adjacent its connection to the exhaust duct 84. The purpose of the baffle is to control the flow of air, so that the incoming air will not pass directly to th exhaust duct 84.

Turning now to FIG. 4 of the drawings, it will be seen that a slightly modified form of the invention is shown. In this embodiment all of the structure is the same as that of the previously described embodiment except that the flange 168 at the bottom of the outer spout member 66 extends horizontally outward therefrom and has an annular seal 169 attached to its lower surface. This arangement is suitable for filling a linerless container where no filling funnel is used. When the pouring spout assembly is in its lower or filling section, the outer spout member flange and seal will directly engage the upper surface of the container around the filling opening.

Thus, it will be appreciated that the invention provides a means for expeditiously and efficiently filling a bulk container with particulate material, whether the container has a liner bag or not, by means of the novel introduction of air into the container and exhaustion of air from the container during the filling operation.

What is claimed is:

1. In an apparatus for transferring particulate material from a material containing hopper having a discharge conduit extending downwardly therefrom toward a rigid bulk container having a top wall with a filling opening extending therethrough to fill a flexible liner bag disposed within in the container and having an open upper end extending upwardly through a filling funnel removably and loosely positioned in said opening, said apparatus further comprising:

(a) a filling spout assembly including a pair of generally cylindrical, concentric, inner and outer spout members defining a passageway therebetween;

(b) said inner spout member having an upper end fixedly secured to a lower end of said hopper discharge;

(c) said outer spout member also having an upper end connected to the lower end of the hopper conduit by a tubular, filexible, bellows member that allows axial movement of said outer spout member relative to said inner spout member;

(d) said outer spout member having at a lower end thereof a filling flange adapted for sealing engagement with said liner bag within said filling funnel;

(e) moving means attached to said outer spout member and being operable to move said outer spout member axially, relative to said inner spout member, toward and away from said container betweeen filling and non-filling positions;

(f) air transfer means for effecting the flow of air into said container liner bag and out of said container liner bag through said passageway, as the liner bag is being filled, to:

(i) inflage the liner bag and force it against inner surfaces of the container;

(ii) force air in the container between the outer surface of the liner bag and the inner surfaces of the container out of the container through the container hatch hole outwardly adjacent said filling funnel;

(iii) compact material entering the liner bag;

(iv) exhaust dust from the liner bag;

(g) said transfer means including a pair of flexible air intake and air exhaust ducts connected to said outer spout member and a baffle positioned in said passageway between said ducts for deflecting incoming air from said said exhaust duct.

* * * * *